US010737820B2

(12) United States Patent
Zhou et al.

(10) Patent No.: US 10,737,820 B2
(45) Date of Patent: Aug. 11, 2020

(54) APPARATUS FOR PACKING PRODUCTS INTO CONTAINERS

(71) Applicant: The Procter & Gamble Company, Cincinnati, OH (US)

(72) Inventors: Runheng Zhou, Guangzhou (CN); Fumin Liu, Guangzhou (CN); Gaspar Andres, Singapore (SC); Yong Qing Ye, Guangzhou (CN); Dale Francis Bittner, Harrison, OH (US); Philippe Elie Benros, Guangzhou (CN); Poe Zhao, Guangzhou (CN)

(73) Assignee: The Procter and Gamble Company, Cincinnati, OH (US)

( * ) Notice: Subject to any disclaimer, the term of this patent is extended or adjusted under 35 U.S.C. 154(b) by 779 days.

(21) Appl. No.: 14/542,684

(22) Filed: Nov. 17, 2014

(65) Prior Publication Data

US 2015/0068156 A1 Mar. 12, 2015

(30) Foreign Application Priority Data

Jul. 24, 2012 (WO) ..... PCT/CN2012/079083

(51) Int. Cl.
*B65B 63/00* (2006.01)
*B65B 63/04* (2006.01)
(Continued)

(52) U.S. Cl.
CPC ..... *B65B 63/04* (2013.01); *B65B 5/061* (2013.01); *B65B 35/50* (2013.01); *B65B 39/003* (2013.01); *B65B 39/005* (2013.01); *B65B 61/28* (2013.01)

(58) Field of Classification Search
CPC ..... B65B 63/04; B65B 35/50; B65H 45/1015; B65H 45/107; B65H 45/4216; B65H 45/4223
(Continued)

(56) References Cited

U.S. PATENT DOCUMENTS 2,655,978 A 10/1953 Desire
2,915,109 A 12/1959 Walton
(Continued)

FOREIGN PATENT DOCUMENTS

BE 900166 A 11/1984
CN 200945950 Y 9/2007
(Continued)

OTHER PUBLICATIONS

PCT International Search Report and written opinion dated May 2, 2013, 11 pages.
(Continued)

*Primary Examiner* — Chelsea E Stinson
(74) *Attorney, Agent, or Firm* — Alexandra S. Anoff

(57) ABSTRACT

A method and apparatus for packing products into containers is described herein. More particularly, the method and apparatus are directed to packaging sheets of packages such as pouches or sachets that are joined together end-to-end. The apparatus may include a folding mechanism and a collection receptacle. The method and apparatus may perform one or more steps simultaneously so that the folding and packing of such sheets into containers can be carried out without the flow of incoming sheets being interrupted.

16 Claims, 3 Drawing Sheets

(51) Int. Cl.

| | |
|---|---|
| ***B65B 61/28*** | (2006.01) |
| ***B65B 39/00*** | (2006.01) |
| ***B65B 5/06*** | (2006.01) |
| ***B65B 35/50*** | (2006.01) |

(58) Field of Classification Search
USPC ..... 53/429, 116; 493/421, 430, 433, 356, 493/411, 448
See application file for complete search history.

(56) References Cited

U.S. PATENT DOCUMENTS 3,066,932 A 12/1962 Greiner
3,165,310 A 1/1965 Peterson
3,184,895 A 5/1965 Oconnor
3,218,776 A 11/1965 Cloud
3,267,639 A 8/1966 Honore
3,343,336 A 9/1967 Bradford
3,345,795 A 10/1967 Anderson
3,354,611 A 11/1967 Powell
3,401,927 A 9/1968 Frick
3,451,187 A 6/1969 Massey
3,453,801 A 7/1969 Stohlquist
3,475,878 A 11/1969 West, Jr.
3,555,768 A 1/1971 Miller
3,577,700 A 5/1971 Bippus
3,641,735 A 2/1972 Dailey et al.
3,641,737 A 2/1972 Tamagni
3,660,962 A 5/1972 Bliss
3,673,760 A 7/1972 Canamero
3,685,251 A 8/1972 Mahaffy
3,784,186 A 1/1974 Lenthall
3,808,772 A 5/1974 Turtschan
3,831,501 A 8/1974 Bevington
3,851,445 A 12/1974 Schuh
3,958,394 A 5/1976 Mahaffy
3,978,637 A 9/1976 Mauriello
4,001,075 A 1/1977 Menzner
4,017,247 A 4/1977 Soukup
4,027,459 A 6/1977 Palmkoeck
4,034,536 A 7/1977 Mahaffy
4,047,359 A 9/1977 Gronebaum
4,115,182 A 9/1978 Wildmoser
4,170,347 A 10/1979 Lewis
4,215,524 A 8/1980 Saylor
4,235,329 A 11/1980 Aterianus
4,301,639 A 11/1981 Hamilton
4,329,830 A 5/1982 Omori
4,349,997 A 9/1982 Hayasaka
4,433,527 A 2/1984 Ramsey
4,512,138 A 4/1985 Greenawalt
4,537,016 A 8/1985 Shanklin
4,549,386 A 10/1985 Wilson
4,551,965 A 11/1985 Prottengeier
4,589,568 A 5/1986 Ito
4,715,166 A 12/1987 Kameda
4,735,738 A 4/1988 Willman
4,807,420 A 2/1989 Barker
4,819,406 A 4/1989 Redmond
4,819,412 A 4/1989 Sengewald
4,846,454 A * 7/1989 Parkander ..... B65H 35/10 270/5.02
4,869,048 A 9/1989 Boeckmann
4,876,842 A 10/1989 Ausnit
4,970,846 A 11/1990 Leino
4,987,728 A 1/1991 Ventura
5,003,752 A 4/1991 Matsumoto
5,067,302 A 11/1991 Boeckmann
5,074,837 A * 12/1991 Blanton, III ..... B65H 45/1015 493/410
5,076,040 A 12/1991 Davis
5,224,601 A 7/1993 Gouge
5,341,623 A 8/1994 Siegel
5,408,806 A 4/1995 Lin
5,419,801 A 5/1995 Mcdonald
5,443,779 A 8/1995 Ichikawa
5,524,420 A 6/1996 Ikuta
5,564,261 A 10/1996 Kiner
5,589,014 A 12/1996 Hicks
5,622,263 A * 4/1997 Greenland ..... A45D 40/0087 206/484
5,660,662 A 8/1997 Testone
5,682,732 A 11/1997 Selberg
5,713,186 A 2/1998 Bruhn
5,823,234 A 10/1998 Boertz
5,837,740 A 11/1998 Haraguchi
5,868,901 A 2/1999 Smith
5,870,884 A 2/1999 Pike
5,896,994 A 4/1999 Krebs
5,954,086 A 9/1999 Ronchi
5,996,650 A 12/1999 Phallen
6,037,319 A 3/2000 Dickler
6,041,580 A 3/2000 Wojtech
6,138,436 A 10/2000 Malin
6,167,681 B1 1/2001 Yano
6,227,415 B1 5/2001 Ritsche
6,230,781 B1 5/2001 Smith
6,244,021 B1 6/2001 Ausnit
6,293,402 B1 9/2001 Rogers
6,363,693 B1 4/2002 Edwards
6,378,274 B1 4/2002 Harbour
6,379,483 B1 4/2002 Eriksson
6,481,183 B1 11/2002 Schmidt
6,481,188 B1 11/2002 Graham
6,484,479 B1 11/2002 Minion
6,484,745 B1 11/2002 Navarro
6,506,329 B1 1/2003 Curro
6,562,166 B2 5/2003 Molander
6,651,406 B2 11/2003 Sperry
6,689,214 B2 2/2004 Burmester
6,745,545 B2 6/2004 Schneider
6,761,016 B1 7/2004 Soleri
6,790,312 B2 9/2004 Cosaro
6,874,300 B2 4/2005 Di Lauretis et al.
6,896,950 B2 5/2005 Forman
6,904,735 B2 6/2005 Mcmahon
6,955,733 B2 10/2005 Miller
6,986,236 B2 1/2006 Schneider
7,003,934 B1 2/2006 Yano
7,067,186 B2 6/2006 Oguro
7,235,115 B2 6/2007 Duffy
7,325,386 B2 2/2008 Kissling
7,325,688 B1 2/2008 Tessmer
7,640,717 B2 1/2010 Shokri
7,673,864 B2 * 3/2010 Mizuno ..... B65H 23/042 270/30.01
7,775,017 B2 8/2010 Stowell
7,797,912 B2 9/2010 Hammond
7,963,899 B2 6/2011 Papsdorf
8,171,703 B2 5/2012 Arlinghaus
8,225,583 B2 7/2012 Waldherr
8,360,948 B1 * 1/2013 Sjostedt ..... B65H 31/10 493/356
8,567,159 B2 10/2013 Sperry
8,572,936 B2 11/2013 Mancin
8,691,206 B2 4/2014 Kurisawa
8,802,782 B2 8/2014 Becker
9,452,853 B2 9/2016 Doll
9,643,812 B2 5/2017 Orndorff
9,751,291 B2 9/2017 Orndorff
9,783,330 B2 10/2017 Orndorff
9,809,336 B2 11/2017 Pallotta
10,259,602 B2 4/2019 Pallotta
10,618,767 B2 4/2020 Orndorff
10,625,886 B2 4/2020 Orndorff
2002/0033004 A1 3/2002 Edwards
2002/0052283 A1 * 5/2002 Miki ..... B31F 1/0019 493/430
2002/0166788 A1 11/2002 Sperry
2002/0170271 A1 11/2002 Pearce
2003/0089084 A1 5/2003 Ausnit
2003/0116204 A1 6/2003 Volovets
2003/0126838 A1 7/2003 Mcmahon
2003/0145558 A1 8/2003 Schneider

(56) References Cited

U.S. PATENT DOCUMENTS

| | | | |
|---|---|---|---|
| 2003/0172622 | A1 | 9/2003 | Kinigakis |
| 2004/0045256 | A1 | 3/2004 | Kinigakis |
| 2004/0065421 | A1 | 4/2004 | Cabell |
| 2004/0089407 | A1 | 5/2004 | Halewood |
| 2004/0121687 | A1 | 6/2004 | Morman |
| 2004/0144065 | A1 | 7/2004 | Smith |
| 2004/0194429 | A1 | 10/2004 | Schneider |
| 2005/0183394 | A1 | 8/2005 | Hammond |
| 2005/0284106 | A1 | 12/2005 | Ausnit |
| 2006/0144020 | A1 | 7/2006 | Kettner |
| 2006/0177156 | A1 | 8/2006 | Owen |
| 2006/0210773 | A1 | 9/2006 | Kannankeril |
| 2007/0185402 | A1 | 8/2007 | Yang |
| 2007/0199280 | A1 | 8/2007 | Thomas |
| 2007/0252276 | A1 | 11/2007 | Lloyd-george |
| 2008/0000202 | A1 | 1/2008 | Kettner |
| 2008/0250753 | A1 | 10/2008 | Sperry |
| 2009/0199877 | A1 | 8/2009 | Koch |
| 2010/0061666 | A1 | 3/2010 | Sprehe |
| 2010/0065187 | A1 | 3/2010 | Vaillant |
| 2010/0147884 | A1 | 6/2010 | Compton |
| 2010/0266818 | A1 | 10/2010 | Westwood |
| 2010/0307948 | A1 | 12/2010 | Domingues |
| 2010/0310732 | A1 | 12/2010 | Domingues |
| 2011/0000613 | A1 | 1/2011 | Cigallio |
| 2011/0027438 | A1 | 2/2011 | Finkowski |
| 2011/0036741 | A1 | 2/2011 | Moehlenbrock |
| 2011/0038570 | A1 | 2/2011 | Moehlenbrock |
| 2011/0038571 | A1 | 2/2011 | Moehlenbrock |
| 2011/0038572 | A1 | 2/2011 | Moehlenbrock |
| 2011/0038573 | A1 | 2/2011 | Moehlenbrock |
| 2011/0060447 | A1 | 3/2011 | Mclaughlin |
| 2011/0094193 | A1 | 4/2011 | Daelmans |
| 2012/0005993 | A1 | 1/2012 | Doll |
| 2013/0219827 | A1 | 8/2013 | Pallotta |
| 2013/0219832 | A1 | 8/2013 | Pallotta |
| 2014/0077006 | A1 | 3/2014 | Goudy |
| 2014/0116605 | A1 | 5/2014 | Kohler |
| 2015/0251403 | A1 | 9/2015 | Orndorff |
| 2015/0251782 | A1 | 9/2015 | Orndorff |
| 2015/0251783 | A1 | 9/2015 | Orndorff |
| 2015/0251871 | A1 | 9/2015 | Orndorff |
| 2017/0020393 | A1 | 1/2017 | Rentschler |
| 2017/0036195 | A1 | 2/2017 | Duff |
| 2017/0334186 | A1 | 11/2017 | Orndorff |
| 2018/0022486 | A1 | 1/2018 | Pallotta |

FOREIGN PATENT DOCUMENTS

| | | | |
|---|---|---|---|
| CN | 201834240 | U | 5/2011 |
| CN | 202214070 | U | 5/2012 |
| EP | 0364084 | A1 | 4/1990 |
| EP | 0840355 | A1 | 5/1998 |
| EP | 1375351 | A1 | 1/2004 |
| EP | 1808482 | A1 | 7/2007 |
| EP | 1026077 | B1 | 5/2008 |
| EP | 2292520 | A1 | 3/2011 |
| EP | 1927463 | B1 | 6/2018 |
| FR | 2905121 | A | 9/2010 |
| GB | 598433 | | 2/1948 |
| GB | 712485 | A | 7/1954 |
| GB | 1433910 | | 4/1976 |
| GB | 2054512 | A | 2/1981 |
| GB | 2089311 | B | 2/1984 |
| GB | 2165202 | B | 5/1988 |
| GB | 2246998 | A | 2/1992 |
| IN | 189471 | A | 9/1993 |
| JP | 5416263 | U | 5/1978 |
| JP | H04583 | B2 | 1/1992 |
| JP | 2001240004 | A | 9/2001 |
| JP | 2005343473 | A | 12/2005 |
| JP | 2007039050 | A | 2/2007 |
| JP | 3918572 | B2 | 5/2007 |
| JP | 2008189332 | A | 8/2008 |
| JP | 2008207830 | A | 9/2008 |
| JP | 4680569 | B2 | 5/2011 |
| WO | WO9842576 | A1 | 10/1998 |
| WO | WO0179416 | A1 | 10/2001 |
| WO | WO0242408 | A2 | 5/2002 |
| WO | WO03026999 | A1 | 4/2003 |
| WO | WO2004033301 | A1 | 4/2004 |
| WO | WO 2010/002853 | A2 | 1/2010 |
| WO | WO2010066509 | A1 | 6/2010 |
| WO | WO2010136282 | A1 | 12/2010 |
| WO | WO2010140242 | A1 | 12/2010 |

OTHER PUBLICATIONS

All final and non-final office actions for U.S. Appl. No. 13/776,753.
All final and non-final office actions for U.S. Appl. No. 13/776,761.
All final and non-final office actions for U.S. Appl. No. 14/198,985.
All final and non-final office actions for U.S. Appl. No. 14/199,002.
All final and non-final office actions for U.S. Appl. No. 14/199,040.
All final and non-final office actions for U.S. Appl. No. 14/632,150.
All final and non-final office actions for U.S. Appl. No. 15/473,676.
All final and non-final office actions for U.S. Appl. No. 15/663,860.
All final and non-final office actions for U.S. Appl. No. 15/690,365.
All final and non-final office actions for U.S. Appl. No. 15/724,290.
Author Unknown, Origami image retrieved from Google images, publisher and publication unknown, image file dated Sep. 20, 2012, 1 page.
PCT International Search Report and Written Opinion for PCT/US2013/027790 dated May 8, 2013.
PCT International Search Report and Written Opinion for PCT/US2015/017714 dated Jul. 28, 2015.
PCT International Search Report and Written Opinion for PCT/US2015/017715 dated May 20, 2015.
PCT International Search Report and Written Opinion for PCT/US2015/017716 dated May 19, 2015.
PCT International Search Report for PCT/US2013/027774 dated Jul. 24, 2013.
PCT Invitation to Pay Additional Fees and, Where Applicable, Protest Fee for PCT/US2013/027774 dated May 13, 2013.
PCT Invitation to Pay Additional Fees, and, Where Applicable, Protest Fee for PCT/US2015/017714 dated May 22, 2015.
Website for Former Fab® Company as of Feb. 1, 2014, http://www.former-fab.de/en/ideasinnovations/longitudinal-corrugating-technology/.
"Improving Forming Shoulder Design" article, University of Bath Dept. of Mechanical Engineering, 1 page, www.bath.ac.uk/~ensgm/shoulder.pdf.
Definition of "Pleat", Merriam-Webster Online Dictionary retrieved from URL https://www.merriam-webster.com/dictionary/pleat on Oct. 30, 2019.

* cited by examiner

APPARATUS FOR PACKING PRODUCTS INTO CONTAINERS

FIELD OF THE INVENTION

A method and apparatus for packing products into containers is described herein.

BACKGROUND OF THE INVENTION

Unit doses of liquid products such as shampoo and hair conditioner are often placed in relatively thin, flat packages known as sachets. Such sachets are typically made using vertical forming, filling and sealing (VFFS) processes. Horizontal forming, filling, and sealing (HFFS) processes for making sachets can also be used.

The output of these processes may be a continuous sheet of sachets that are joined together end-to-end. In some cases, the sheet of sachets may also be of a width comprised of several sachets joined side-by-side. Such a sheet of sachets will be referred to herein as a sheet or "mat" of sachets.

There is a need to package such continuous sheets of sachets into containers such as boxes or cases for shipment. In particular, there is a need for improved processes of folding such sheets and placing the same into containers for shipment. Some prior processes of folding and packing such sheets require that the flow of incoming sheets be interrupted in order to carry out one or more steps of placing the folded sheets into containers.

The search for improved packing processes has, therefore, continued. In particular, there is a need for faster processes for packing products such as sachets into containers.

SUMMARY

A method and apparatus for packing products into containers is described herein.

The method comprises:

a) providing an apparatus for packing sheets of packages into a container, said apparatus comprising a pivotable folding mechanism, and a collection receptacle;

b) providing a container beneath said collection receptacle;

c) feeding unfolded sheets of packages, which packages are joined end-to-end, into said apparatus in a machine direction;

d) folding individual sheets of packages in said folding mechanism;

e) stacking folded individual sheets of packages in stacks in said collection receptacle; and f) dropping said folded stacks of individual sheets of packages in said collection receptacle into said container.

The apparatus comprises:

an infeed mechanism for receiving a sheet of packages being fed into the apparatus in a machine direction, wherein said packages in said sheet are joined end-to-end;

a pivotable folding mechanism located downstream of the infeed mechanism, said folding mechanism comprising a folding arm that is pivotable about an axis that is oriented in a cross machine direction, said arm having a range of motion, and during at least part of its range of motion being pivotable upward toward a horizontal orientation and downward to fold the sheets of the packages into discrete lengths that will form folded individual sheets; and a collection receptacle located beneath at least a portion of the folding mechanism, said collection receptacle having an openable feature having an open position and a closed position, said collection receptacle being for accumulating individual folded sheets of packages, and for transferring the folded sheets of packages to a container when the openable feature is opened.

The method and apparatus may optionally further comprises a holding mechanism located beneath at least a portion of the pivotable folding mechanism for holding at least a portion of the individual sheets while they are being folded. The holding mechanism can be in any suitable configuration. In one embodiment, the holding mechanism comprises at least one rotatable element that is rotatable about an axis that is oriented in a cross machine direction and has at least two members extending outward from the axis about which the rotatable element rotates.

DETAILED DESCRIPTION OF THE INVENTION

A method and apparatus for packing packages into containers is described herein. More particularly, the method and apparatus are directed to packaging sheets of packages such as pouches or sachets that are joined together end-to-end.

The packages can be unit dose packages, and can be in any suitable configuration. The contents of the package can be in any suitable form including, but not limited to solids, liquids, pastes, and powders. The packages may be filled with products which may include personal care products or household care products including, but not limited to, shampoo, hair conditioners, hair colorants (dyes and/or developers), laundry detergents, fabric softeners, dishwashing detergents, and tooth paste. The packages can contain other types of products including, but not limited to food products such as ketchup, mustard, mayonnaise, and orange juice. Packages in the form of pouches or sachets are typically relatively thin and flat, and in some cases, may be provided with water vapor barrier properties to prevent water loss from the product in the package over time, or water intrusion into the product from outside the package.

Figure 1:
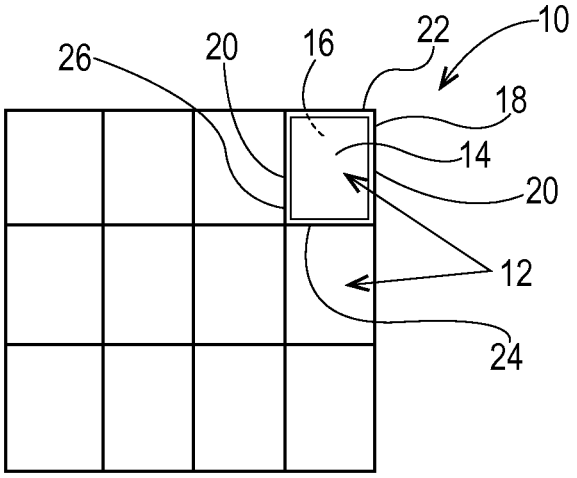
FIG. 1 is a schematic front view of a sheet of sachets in which one of the sachets is shown in detail.

FIG. 1 shows one non-limiting example of a sheet of sachets 10. The sachets 12 are in the form of a prior art sachet. The sachet 12 has a front 14, a back 16, a periphery 18, two sides 20, a top 22, and a bottom 24. The sachet 12 further has a seal 26 around the periphery. The sachets 12 will include a product within the same, in the region located inside the seal 26. The sachet 12 may be in any suitable configuration including, but not limited to the rectangular shape shown. The sachet may have any suitable dimensions.

The package, such as sachet 12 can be made of any suitable materials. Suitable package materials include films, and woven or nonwoven materials (in cases where the sachet contains a solid product), or laminates of any of the foregoing. If desired, the package material can comprise a liquid and/or vapor barrier in the form of a layer or a coating. In some cases, the sachets 10 are made of two pieces of the same film that form the front 14 and back 16 of the sachet. The film can be any suitable type of film including single layer films and laminates. The sachets 12 that are made in a HFFS or VFFS machine are arranged in a continuous sheet 10 of sachets that are joined together end-to-end. In some cases, the sheet of sachets may also be of a width comprised of several sachets joined side-by-side. Such a sheet 10 of sachets will be referred to herein as a sheet or "mat" of sachets. There may or may not be perforations between the individual sachets in the sheet of sachets. The sealed areas 26 will typically be thinner than the portion of the sachet 12 containing the product. These sealed areas 26 will, thus, form regions that can be folded.

Figure 2:
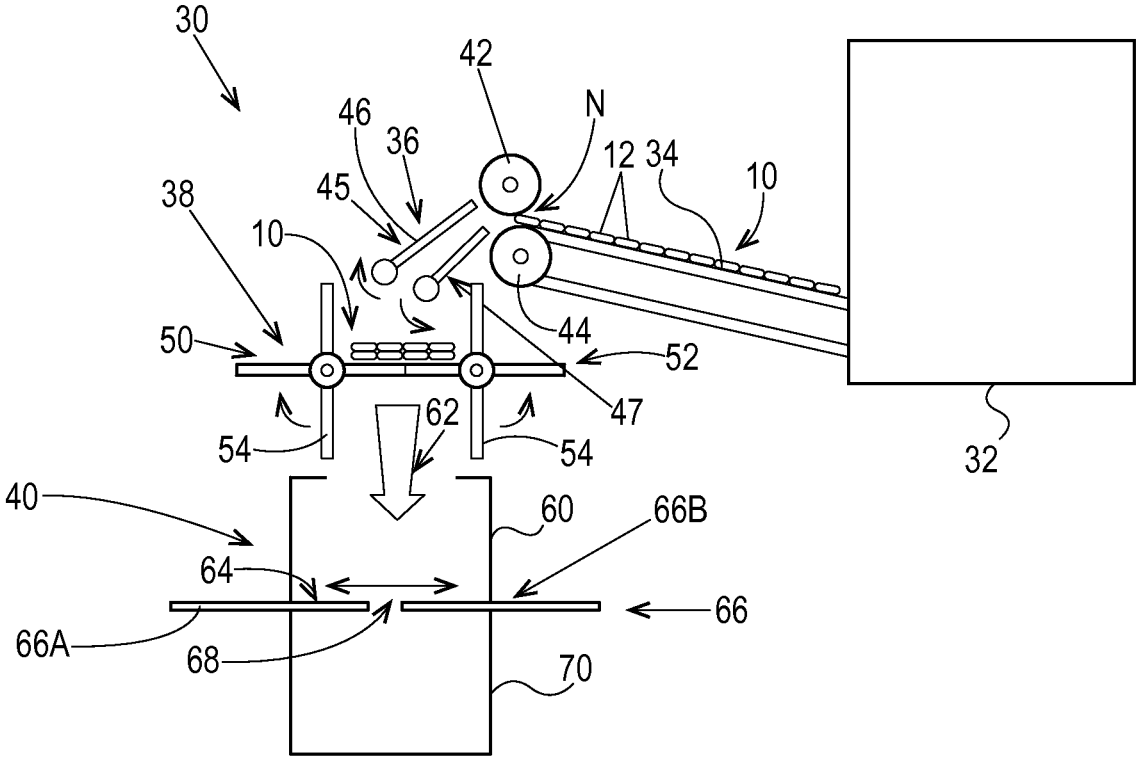
FIG. 2 is a schematic side view of a method and apparatus for packing products into containers.

FIG. 2 shows an apparatus 30 for packing products (for example, packages containing products) into containers. The apparatus 30 is located downstream of a sachet sealing and cutting machine 32 (which machine is not part of the present invention). The sachet sealing and cutting machine 32 forms the sealed areas 26, and cuts the sheet 10 of sachets in some of the sealed areas 26. The sheet 10 of sachets can be cut in the cross-machine direction (or "CD") and/or in the machine direction (or "MD"). The sheet 10 of sachets may have perforations in the sealed areas 26 between every sachet 12 so that the sachets may be readily separated from one another in locations where they have not been cut. Typically, the sheet 10 of sachets will not be cut between every sachet 12 for convenience in packing the sachets. For example, it may be desirable for the sheet 10 of sachets to be cut in the cross-machine direction after each sixth, eighth, twelfth, fifteenth, or sixteenth sachet. For instance, in the case of sheets 10 cut after each sixth sachet, this will allow the sheet 10 to be folded into a two layer folded sheet in which each layer is three sachets in length.

The apparatus 30 comprises an infeed mechanism 34 in an infeed zone, a folding mechanism 36 located downstream of the infeed zone, an optional holding mechanism 38 located beneath at least a portion of the folding mechanism 36, and a collection receptacle 40 in a discharge zone located beneath at least a portion of the holding mechanism 38 (or beneath the folding mechanism if there is no holding mechanism). The components of the apparatus 30, and variations thereof, are as follows.

The infeed mechanism 34 comprises a device for receiving a sheet of products (e.g., a sheet of packages of products). The sheet of products 10 is fed into the apparatus in a machine direction, and the products are in the form of cut sheets as described above comprising at least two sachets joined end-to-end. The infeed mechanism 34 can comprise any suitable type of device. In the version of the apparatus shown in FIG. 2, the infeed mechanism 34 comprises a conveyor. The infeed conveyor 34 may terminate prior to the folding mechanism 36.

The apparatus 30 may optionally comprise a mechanism for controlling the drop of the sheets of products 10 from the infeed mechanism 34 to minimize any free fall of the sheets of products. This mechanism is located at the end of the infeed mechanism 34, or downstream of the infeed mechanism. This mechanism can comprise any suitable mechanism capable of performing this function. In the version of the apparatus shown in FIG. 2, the mechanism comprises a nip N formed by two rolls 42 and 44.

The folding mechanism 36 is located downstream of the infeed zone. The folding mechanism 36 can comprise any mechanism that is capable of folding the sheets of products 10 so that one portion of the folded sheet is disposed adjacent to another portion of the folded sheet. Such folding may also be referred to herein as "festooning". One example of a suitable folding mechanism is the pivotable folding mechanism shown in FIG. 2. The folding mechanism 36 comprises a component that is pivotable about an axis that is oriented in a cross machine direction. The component may be downwardly depending (at least through part of its range of motion), and pivotable upward toward a horizontal orientation and downward to fold the sheets of the products 10 into discrete lengths that will form a layer or layers of the folded sheet. The sheets of the products 10 can be folded into any suitable discrete lengths including, but not limited to lengths of between 2 and 5 sachets, alternatively between 3 and 4 sachets, per layer. The number of sachets in each layer will depend on the size of the container into which the products will be placed.

In the version of the apparatus shown in FIG. 2, the pivotable folding mechanism 36 comprises a compact and lightweight folding arm 45 that comprises at least one plate. More specifically, in the embodiment shown, the folding arm 45 is in the form of a pair of spaced apart plates 46 and 47. Plate 46 will be referred to as the first or "upper plate" and plate 47 will be referred to as the second or "lower plate". The plates 46 and 47 can be in any suitable size and configuration. The plates 46 and 47 can be of the same size, or one plate can be larger in one or more dimensions than the other. For example, the plates can have the same cross-machine direction dimension, and upper plate 46 may be longer in the machine direction (when viewed from the side as in the drawings) than the lower plate 47. The plates 46 and 47 can be in the form of a flat metal or plastic rectangular plate. In other embodiments, the plates 46 and 47 can be curved when viewed from the side. The plates 46 and 47 can be curved concavely or convexly with respect to the incoming sheets of products 10. The folding arm 45 may be free of moving parts such conveyors for conveying the sheet of products 10 in the space between the plates 46 and 47.

In the embodiment shown in FIGS. 3A-3E, the plates 46 and 47 are flat and the folding mechanism 36 further comprises a stationary upper curved plate 48 and a stationary lower curved plate 49. The function of the curved plates 48 and 49 is to guide the incoming sheets of products 10 from a generally horizontal orientation to a declined machine direction orientation. The upper plate 46 is pivotably attached to a support structure adjacent the lower end of the stationary upper curved plate 48, and the lower plate 47 is pivotably attached to a support structure adjacent the lower end of the stationary lower curved plate 49. The flat plates 46 and 47 and the curved plates 48 and 49 can be oriented in any suitable relationship to each other. The flat plates 46 and 47 and the curved plates 48 and 49, respectively, can be oriented substantially parallel to each other, or they can be angled inward toward each other, or angled outward away from each other. The relationship of the curved stationary plates may differ from that between the flat plates 46 and 47. For example, in the embodiment shown in FIGS. 3A-3E, the curved stationary plates 48 and 49 may have substantially the same curvature and be substantially the same distance apart, while the flat plates 46 and 47 are angled slightly inward toward each other.

The sheets of products 10 will be brought in between the upper plate 46 and the lower plate 47. In FIG. 2, the motion of the folding arm 45 is shown schematically. The folding arm 45 is connected to a mechanism that moves the arm 45 upward and downward in the direction of the arrows. The mechanism that moves the arm 45 upward and downward is not shown, and can be any suitable mechanism or driver including, but not limited to a motor, a linear actuator, or an air cylinder, any of which can be joined to a mechanism to move the folding arm 45 as specified herein. The folding mechanism 36 may further comprise sensors that detect the incoming sheets of products 10, so that the drive that moves the folding arm 45 can be activated at the appropriate time. The sensors can be at any suitable location. For instance, the sensors can be located on or adjacent to the upper and/or lower folding plates 46 and 47, such as at the distal ends of the same. In addition, or alternatively, sensors can be located on or adjacent to the upper and/or lower curved plates 48 and 49.

FIGS. 3A-3E show the operation of the folding arm 45 in greater detail. FIGS. 3A-3E show the sheet of sachets 10 coming in on the infeed conveyor belt 34. The sheets 10 are fed between the infeed conveyor 34 and nip roll 42. The nip roll may rotate at substantially the same speed but in the opposite direction as the infeed conveyor belt 34. The nip roll 42 can be made of a compressible material such as rubber so that the apparatus 30 can handle sachets of varying thicknesses without changing the nip roll. For simplicity of illustration in showing the operation of the folding arm 45, FIGS. 3A-3E are schematic views that show the sheet of sachets 10 being deposited directly into the container 70 (without a holding mechanism or collection receptacle).

Figure 3A:
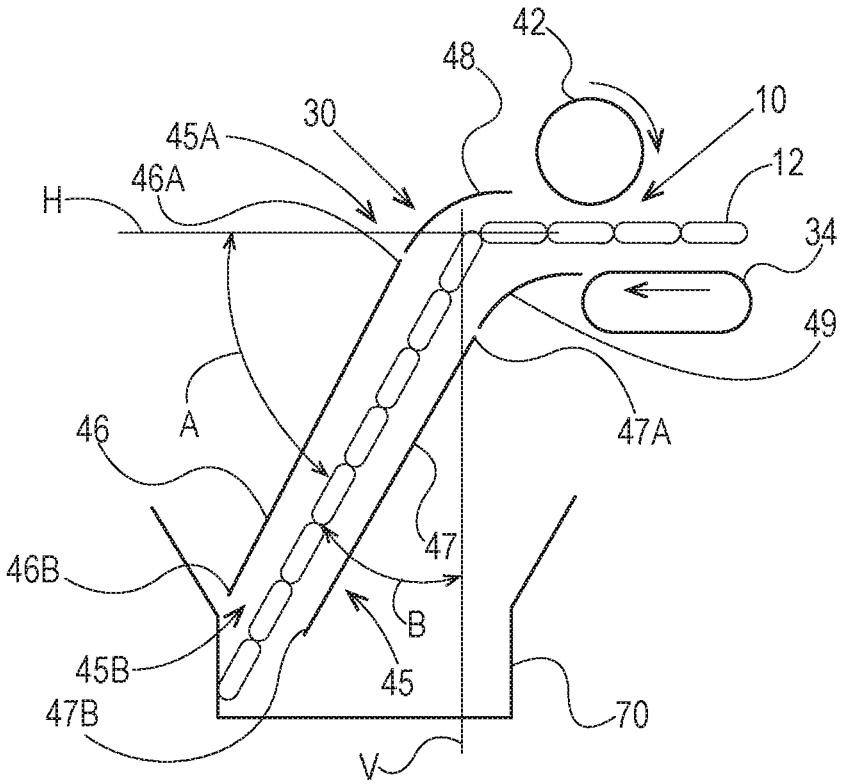
FIG. 3A is a schematic side view of one embodiment of a folding plate of the folding mechanism in a first position with a sheet of products thereon.
Figure 3B:
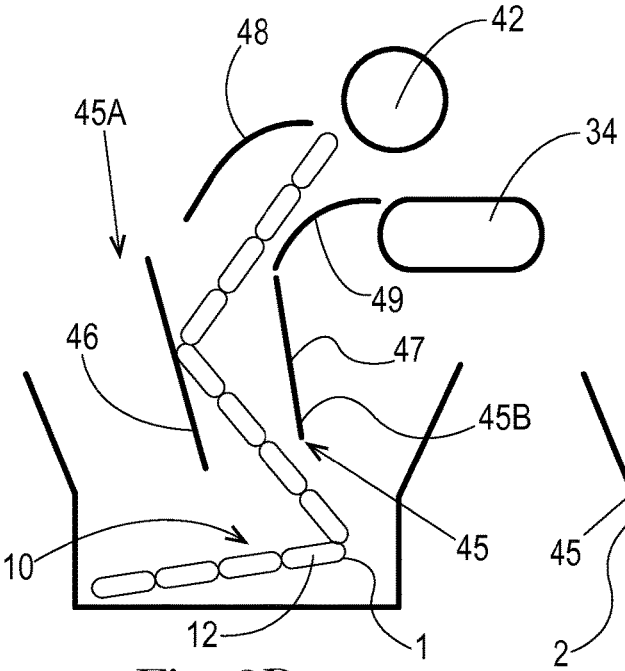
FIG. 3B is a schematic side view of one embodiment of the folding plate in a second position during the process of folding the sheet of products.

The upper and lower folding plates 46 and 47 each have a fixed proximal end 46A and 47A, and a free distal end 46B and 47B, respectively. As shown in FIG. 3B, the folding arm 45 similarly comprises a proximal end 45A and a free distal end 45B. The folding plates 46 and 47 comprising the folding arm 45 are pivotable about axes adjacent to their proximal ends 46A and 47A. FIG. 3A is a schematic side view of one embodiment of a folding arm 45 of the folding mechanism in a first position with a sheet of products 10 between the upper and lower folding plates 46 and 47. The sheet of products 10 is twelve sachets 12 in length, and can be multiple sachets in width. As shown in FIG. 3A, in the first position, the folding arm 45 is at a first angle A that is below a horizontal line, H running through the axis about which the folding arm 45 pivots at its proximal end 45A. Angle A is measured from horizontal line H to the centerline of the sheet of products 10, or if the sheet of products is not present, from the centerline of the folding arm 45. In the first position, a portion of the sheet of products begins to slide out of the folding arm 45 past the distal end 45B of the same.

FIG. 3B shows the folding arm 45 in a second position during the process of folding the sheet of products. In the second position, the distal end 45B of the folding arm 45 drops so that the folding arm 45 is at a second greater angle below the horizontal line H. The second angle can be an angle that is between the first angle and an angle of 90 degrees, or more, relative to the horizontal line H. (An angle of 90 degrees would be vertically downward). In the embodiment shown, the second angle is greater than 90 degrees relative to the horizontal line H. Thus, the folding arm 45 has a range of motion, and during at least part of its range of motion, the folding arm 45 is downwardly depending, and pivotable through at least a portion of a zone that is between a generally horizontal orientation in a first direction to a generally horizontal orientation in a second direction opposite to said first direction. The second angle is set so that the distal end 45B of the folding arm 54 forms a first fold, 1, in the sheet of products 10. The sheet of products is folded along a line of flexibility through the seal area between sachets 12. In the embodiment shown, this creates a layer that is four sachets long. The folding arm 45 remains in the second position long enough for part of the sheet of products 10 to slide out of the folding arm 45 past the distal end 45B of the same to form the first fold, and may also allow an additional length of the sheet of products 10 to slide past the distal end 45B in order to start forming a second layer of products. Then the folding arm 45 is moved toward the third position.

Figure 3C:
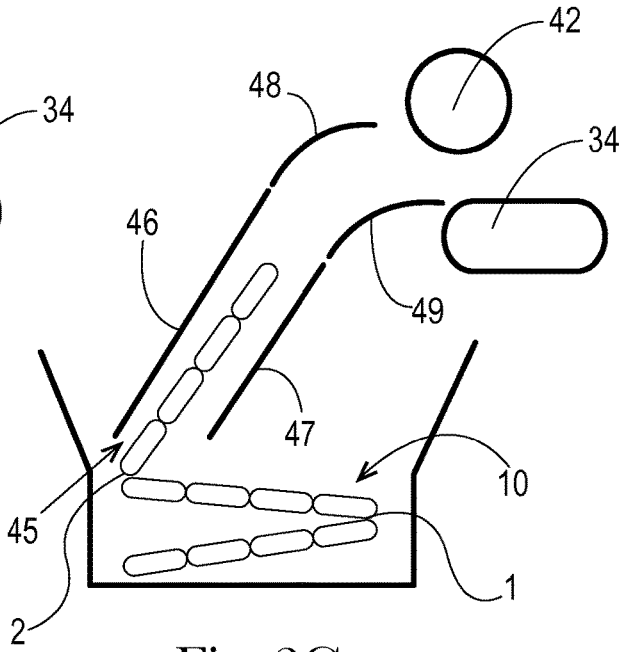
FIG. 3C is a schematic side view of one embodiment of the folding plate in a third position.

FIG. 3C shows the folding arm 45 in a third position. In the third position, the distal end 45B of the folding arm 45 is moved back upward. If it was desirable to only form two layers of sachets (for example, if the sheet of products 10 in this embodiment was only eight sachets long), the folding process would end at this stage. Alternatively, as shown in FIG. 3C, if it is desired to form more than two layers of sachets, at the third position the folding arm 45 folds the sheet of products 10 along a second fold line, 2. The third position can be at the same angle the folding arm 45 formed when it was at the first position, or at some other suitable angle from the horizontal line H that is less than that formed by the folding arm 54 with line H at the second position. After the second fold 2 is made, the folding arm 45 is moved to the fourth position.

Figure 3D:
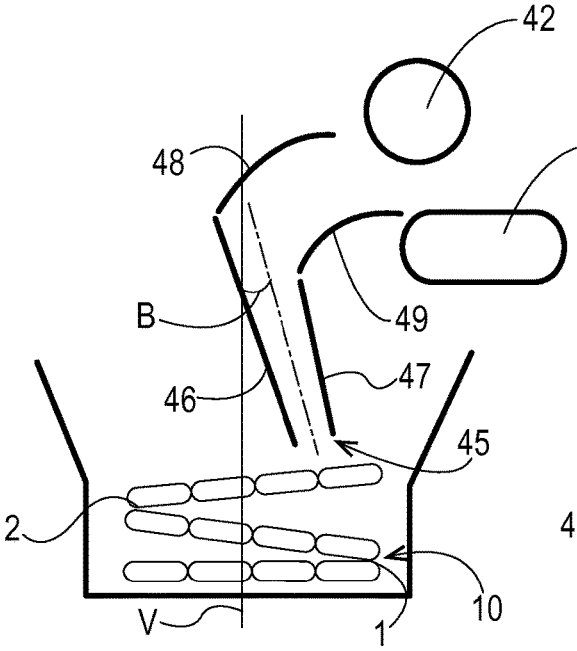
FIG. 3D is a schematic side view of one embodiment of the folding plate in a fourth position.

FIG. 3D shows the folding arm 45 in a fourth position. In the fourth position, the distal end 45B of the folding arm 45 is moved back downward to form another layer of products 10. In the fourth position, the folding arm 45 can be at the same angle formed when it was at the second position, or at some other suitable angle that is greater than the angle formed with line H when it was at the third position. As discussed above, FIGS. 3A-3E show the sheet of sachets 10 being deposited directly into the container 70 for simplicity of illustration. As will be described in further detail below, at this stage, the folded sheet of products 10 is ready to be dropped onto the holding mechanism 38 (or if there is no holding mechanism, into the collection receptacle 40).

Figure 3E:
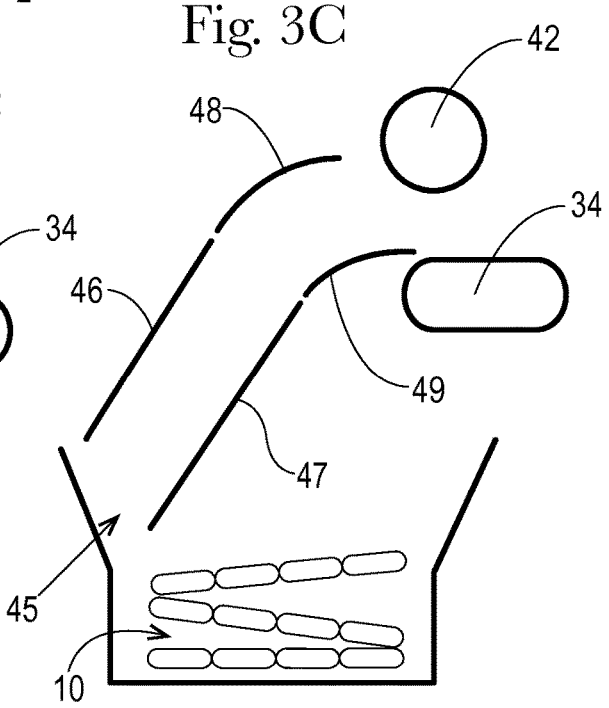
FIG. 3E is a schematic side view of one embodiment of the folding plate after it has returned to the first position.

As shown in FIG. 3E, after the second fold 2 is made, the folding arm 45 is moved back to the first position to receive another sheet of products 10, or to form another fold in the same sheet of a longer sheet of products. It should be noted that in some embodiments, the folding arm 45 may move through a range of motion such that it moves substantially the same angle B on either side of a vertical line, V that runs through the pivot point of the folding arm 45. In other embodiments, however, the folding arm 45 may move through a range of motion that differs on each side of a vertical line, V that runs through the pivot point of the folding arm 45. Angle B is measured from vertical line V to the centerline of the sheet of products 10, or if the sheet of products is not present, from the centerline of the folding arm 45. Thus, angles B shown in FIGS. 3A and 3D (or in any of the other positions) may, but do not have to be of equal magnitude. It is also possible for the folding arm 45 to have a range of motion that moves it above the horizontal line H on either side of the vertical line V during its movement to, or between, one or more positions.

FIG. 2 is a more complete view that shows that the optional holding mechanism 38 located beneath at least a portion of the pivotable folding mechanism 36. The holding mechanism 38 holds the sheet of products 10 during folding (as did container 70 in FIGS. 3A-3E), and drops one or more folded sheets at a time into the collection receptacle 40. The holding mechanism 38 and the collection receptacle 40 located beneath the holding mechanism may serve a time buffering function so that the flow of incoming sheets 10 does not have to be interrupted during the process of packing the folded sheets into containers 70. For instance, it is possible for the sheets of products 10 to be produced faster than the time it takes to place empty containers 70 below the collection receptacle 40. The holding mechanism 38 and the collection receptacle 40 provide time to accumulate folded sheets of products 10 for placement in a container 70 while the folding process is simultaneously taking place. The process does not have to stop or be slowed down if there is not a container 70 in position to receive the folded sheets.

The holding mechanism 38 can comprise any suitable mechanism that is capable of carrying out these functions. Suitable mechanisms include, but are not limited to: receptacles with openable elements such as flaps or sliding gates (such as used for the collection receptacle 40); and mechanisms comprising one or more rotating elements. In the version of the apparatus shown in FIG. 2, there are two rotating elements 50 and 52, each of which comprises a star wheel. The rotating elements 50 and 52 are each rotatable about an axis that is oriented in a cross machine direction. When viewed from the side as in FIG. 2, the rotating elements 50 and 52 each have members or groups of members (such as fingers) 54 extending outward from the axis about which the rotatable elements rotate. The rotating elements 50 and 52 may each have two to four, or more, groups of members or fingers 54. In the embodiment shown, the rotating elements 50 and 52 each have four groups of fingers 54. For each finger 54 shown in FIG. 2, there are several more spaced apart fingers in the cross-machine direction behind the fingers 54 shown. When the rotating elements 50 and 52 are viewed from a location along the machine direction, they may appear like horizontally-oriented turnstiles. Two star wheels are used so that the folded sheets can drop from their centerline into the collection receptacle 40 in a stable folded manner.

The star wheels 50 and 52 rotate so that the fingers 54 on opposing star wheels are aligned in a substantially horizontal position in order to catch the folded sheet 10 when at least a portion of the folded sheet is ready to drop down from the folding mechanism 36. Once the star wheels 50 and 52 catch the folded sheet, and the collection receptacle 40 below is closed, the star wheels 50 and 52 rotate so that the fingers 54 on the star wheels underlying the folded sheet 10 move downward to drop the folded sheet 10 into the collection receptacle 40. Thus, in the embodiment shown, the star wheel 50 to the left of a vertical centerline of the folded sheet will rotate clockwise, and the star wheel 52 to the right of the centerline of the folded sheet will rotate counter-clockwise to open the holding mechanism 38 and drop the folded sheet into the collection receptacle 40.

The collection receptacle 40 is located beneath at least a portion of the holding mechanism 38. The collection receptacle 40 accumulates folded sheets of products, and transfers the folded sheets of products to a container 70. The collection receptacle 40 can accumulate any suitable number of folded sheets of products. The number of folded sheets of products will depend upon thickness of the folded sheets and the height of the container into which the folded sheets are to be placed. In the version of the apparatus shown in FIG. 2, the collection receptacle 40 comprises a receptacle structure having side walls 60 and an opening 62 in the top for receiving the folded sheets of products. The collection receptacle 40 also has a floor 64 upon which the folded sheets of products rest when waiting for a container 70 to be positioned under the collection receptacle 40. The floor of the collection receptacle 40 has an openable feature 66 therein for dropping the folded sheets of products through an opening in the bottom 68 of the collection receptacle 40 into the container below. The openable feature 66 can be any suitable type of mechanism including, but not limited to openable flaps or sliding gates, and one or more rotating elements in which latter case, the collection receptacle may be the same or similar type of mechanism as the holding mechanism 38. In the version of the apparatus shown in FIG. 2, the openable feature comprises a gate 66 having an open position and a closed position, or more particularly, two sliding gate elements 66A and 66B. The sliding gate elements 66A and 66B have a closed position in which the adjacent ends of the gate elements 66A and 66B approach each other, and an open position in which these ends move apart. The gate elements 66A and 66B are shown in a partially opened position in FIG. 2. The collection receptacle 40 accumulates the folded sheets of products, and transfers the folded sheets of products to a container 70 when the gate 66 is opened. The gate 66 then closes to receive additional folded sheets from the holding mechanism 38.

The container 70 can be any suitable container, and will typically be an erected shipper or case. The container 70 may be made of any suitable material, such as cardboard.

Numerous alternative embodiments of the apparatus 30 are possible. For example, in other embodiments, the folding mechanism may comprise only a single plate such as the lower plate 47, and the sheets of products can be fed on top of such a single plate.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for packing sheets of packages of products into a container, said method comprising the steps of:

a) providing an apparatus for packing sheets of packages into a container, said apparatus comprising:

a stationary upper curved plate having a lower end and a stationary lower curved plate having a lower end wherein the stationary upper curved plate and lower curved plate are spaced apart plates adapted to guide the incoming sheets of products;

a pivotable folding arm comprising a pair of spaced apart plates defining a space therebetween, and a collection receptacle;

wherein the pair of spaced apart plates comprises an upper plate having a proximal end pivotably attached to a first support structure adjacent the lower end of the stationary upper curved plate and a free distal end and a lower plate having a proximal end pivotably attached to a second support structure adjacent the lower end of the stationary upper curved plate and a free distal end;

b) providing a container beneath said collection receptacle;

c) feeding unfolded sheets of packages into the space between said plates, which packages are joined end-to-end, into said apparatus in a machine direction;

d) folding individual sheets of packages in said folding arm so that at least two packages joined end-to-end are located between each fold;

e) stacking folded individual sheets of packages in stacks in said collection receptacle; and f) dropping said folded stacks of individual sheets of packages in said collection receptacle into said container.

2. The method of claim 1 wherein said folding arm is pivotable about an axis that is oriented in a cross-machine direction, and said folding arm being pivotable to fold the sheets of the packages into discrete lengths that will form folded individual sheets.

3. The method of claim 2 wherein said unfolded sheets of packages also comprise packages that are joined side-by-side.

4. The method of claim 2 wherein said folding arm has a range of motion, and during at least part of its range of motion, said folding arm is downwardly depending, and pivotable through at least a portion of a zone that is between a generally horizontal orientation in a first direction to a generally horizontal orientation in a second direction opposite to said first direction.

5. The method of claim 4 wherein folds are formed when the folding arm moves through the following positions:

when said folding arm is in a first position, said folding arm receives an unfolded sheet of packages on top of at least a component of said folding arm, wherein the folding arm extends in a first direction that is at a first angle that is below horizontal, wherein a portion of the sheet of products begins to slide past the distal end of the folding arm;

said folding arm moves to a second position that forms a second angle, wherein said second angle lies between the first angle and an angle that is below horizontal in a second direction that is opposite to said first direction, wherein a first fold is formed in said sheet of products;

said folding arm moves to a third position wherein the distal end of the folding arm is moved back toward said first direction to form a second fold in the sheet of packages; and said folding arm moves to a fourth position wherein the distal end of the folding arm moves back toward said second direction to drop the folded portion of the sheet of packages to a location below the folding arm.

6. The method of claim 1 wherein the folding arm is free of moving parts in the space between the spaced apart plates.

7. The method of claim 1 further comprising a holding mechanism located below at least a portion of the pivotable folding mechanism and above said collection receptacle, wherein said holding mechanism comprises at least one element that holds the sheet of products on top of said at least one element during folding, and drops one or more folded sheets at a time into the collection receptacle.

8. The method of claim 7 wherein said at least one element comprises at least one rotating element that is rotatable about an axis that is oriented in a cross machine direction, said rotating element having at least two members extending outward from the axis.

9. The method of claim 7 wherein the folding in step (d) takes place simultaneously with the step (f) of dropping said folded stacks of individual sheets into said container.

10. The method of claim 1 wherein steps (c) through (f) take place simultaneously without interruption of the incoming flow of unfolded sheets of packages.

11. The method of claim 1 wherein said packages are provided with liquid and/or vapor barrier properties.

12. The method of claim 11 wherein said packages contain liquids or pastes.

13. The method of claim 12 wherein said at least two packages joined end-to-end each comprise a portion which contains a product, which portions have a thickness, and there is a sealed area between the portions of said packages containing said product that is thinner than the portions of said packages containing said product.

14. The method of claim 1 wherein the spaced apart plates are oriented substantially parallel to each other.

15. The method of claim 1 wherein the spaced apart plates are angled slightly inward toward each other.

16. The method of claim 1 wherein the folding arm has a range of motion with angle B measured from vertical lines that run through the first and second support structures to a centerline of the sheet products; wherein angles B are equal magnitude throughout the range of motion.

* * * * *